United States Patent [19]

Felter

[11] 4,239,459

[45] Dec. 16, 1980

[54] FAN WITH ADJUSTABLE LEGS FOR IMPROVING BUILDING HEATING AND COOLING

[76] Inventor: John V. Felter, P.O. Box 38271, Houston, Tex. 77088

[21] Appl. No.: 61,487

[22] Filed: Jul. 27, 1979

Related U.S. Application Data

[62] Division of Ser. No. 875,335, Feb. 6, 1978, abandoned.

[51] Int. Cl.[3] ..... F04B 21/00; F16M 11/38

[52] U.S. Cl. ..... 417/234; 415/126; 415/219 R; 417/361; 417/423 R; 417/424; 248/188.6; 248/188.8; 248/588; 248/645; 248/677; 403/61

[58] Field of Search ..... 415/121 R, 126, 219 R; 417/234, 361, 423 R, 424; 248/677, 588, 188.6, 188.8, 150, 168, 293, 645, 667; 403/61

[56] References Cited

U.S. PATENT DOCUMENTS

| | | | |
|---|---|---|---|
| 977,921 | 12/1910 | Zizinia | 248/293 |
| 2,325,754 | 8/1943 | Ebert | 417/424 X |
| 2,633,293 | 3/1953 | Jones | 417/424 X |
| 2,667,301 | 1/1954 | Lautner | 417/361 |
| 2,772,845 | 12/1956 | Conant | 248/150 |
| 3,259,432 | 7/1966 | Jackson | 248/188.8 X |
| 3,635,432 | 1/1972 | Hollander | 248/188.6 |
| 3,870,263 | 3/1975 | Hardiman et al. | 248/168 |

*Primary Examiner*—Leonard E. Smith
*Attorney, Agent, or Firm*—Carl B. Fox, Jr.

[57] ABSTRACT

Method and apparatus for improving building heating and cooling, wherein relatively cooler air is circulated upwardly from adjacent the floor of a room or other space. The upwardly projected relatively cooler air displaces relatively warmer air from the upper part of the room or space, and the warmer air is displaced to a lower level, thereby tending to equalize the air temperatures at different levels of the room or space. The apparatus used for air circulation is adapted for use also in periods when cooling is required, as in summer, in a disposition to propel air horizontally. The apparatus structure includes adjustable legs permitting use of the fan or blower in dual positions.

6 Claims, 6 Drawing Figures

Fig. 1
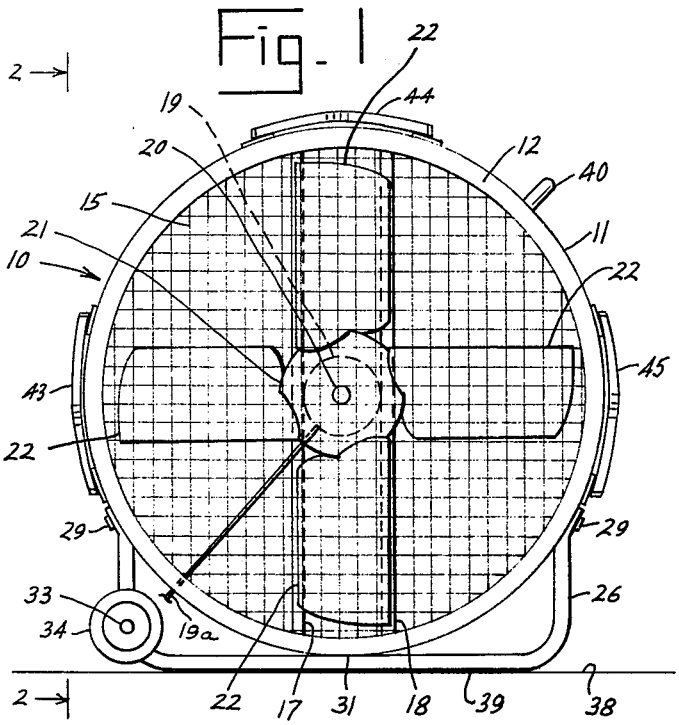
Fig. 2
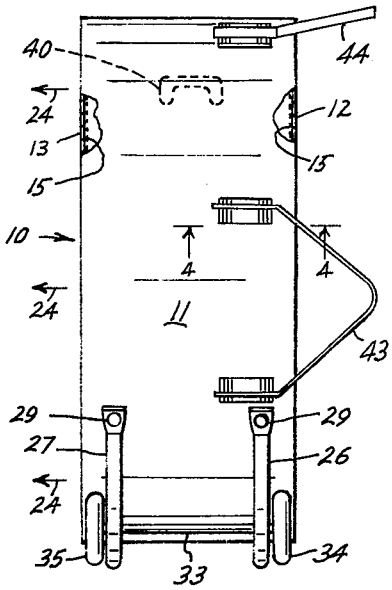
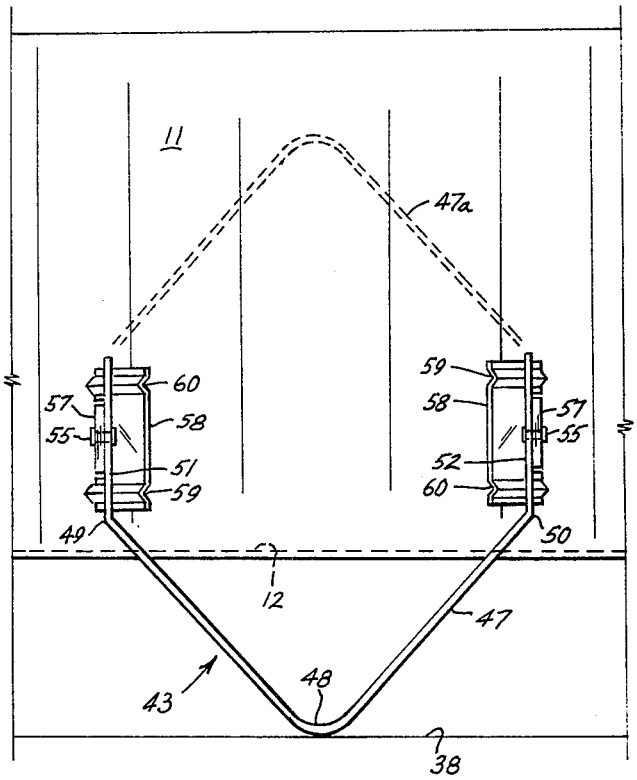
Fig. 3
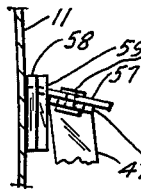
Fig. 5
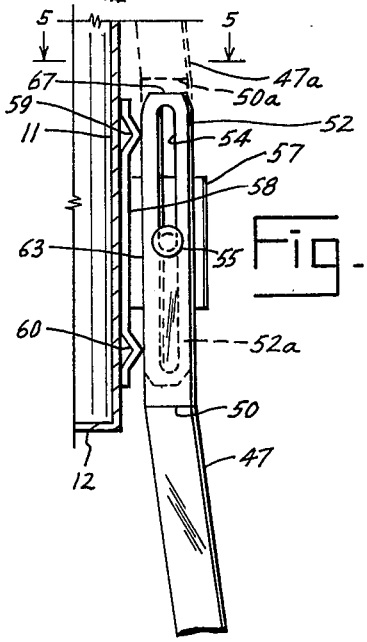
Fig. 4

FAN WITH ADJUSTABLE LEGS FOR IMPROVING BUILDING HEATING AND COOLING

This application is a division of application Ser. No. 875,335, filed Feb. 6, 1978, now abandoned, by the same applicant and of the same title.

BACKGROUND OF THE INVENTION

In a room or a space, warmer air tends to move toward the ceiling while cooler air tends to move toward the floor. This results in different temperatures at different vertical levels in the room or space. This natural form of heat distribution by convection is undesirable, since, in a low ceilinged room, a person's head may be in air which is too warm while his legs and feet are in air which is too cool. In a room having a high ceiling, all of the heat may be concentrated at upper levels of the room or space, while persons at floor level may be too cool. Various devices are known in the art for remedying this situation, none, however, being entirely satisfactory. For example, in U.S. Pat. Nos. 3,173,353, 3,347,025, and 3,482,503, devices are shown for propelling warmer air from the ceiling toward the floor. In U.S. Pat. No. 3,827,342 a device is shown for propelling cooler air from adjacent the floor up through a tubular column to be discharged at the ceiling. In U.S. Pat. No. 3,973,479, both modes of circulation are shown. Most of the devices shown in these patents require the disposition of a tubular structure within the room or space, this being unsightly and undesirable. Furthermore, the devices shown in the patents are useful only in the winter months when heating is required, and are not useful for summer operation. Propulsion of warmer air near the ceiling toward the floor will in most cases result in unwanted drafts and discomfort to occupiers of the room or space. This invention provides an improved method and apparatus for circulating air within a room or space to tend to equalize temperatures at all levels of the room or space.

SUMMARY OF THE INVENTION

The invention provides methods and apparatus for improving building heating and cooling, wherein, according to the methods, cooler air from floor level is circulated toward the ceiling during periods when heating is necessary, as in winter, and provides for use of the same apparatus to achieve cooling during summer and other warm periods. To achieve temperature equalization at different vertical levels within a room or space during periods when heating is required, an air circulating device such as a fan or blower is disposed adjacent the floor of the room or space in a horizontal position so that the fan or blower drives cooler air from floor level toward the ceiling of the room. The cool air is flowed toward the ceiling in an unconfined flow path, without any structural flow passageway. Preferably the fan or blower is disposed at a central location in the room or space so that air intake is uniform therearound and so that the air is directed rapidly toward the ceiling over a limited area to spread in all radial directions to cause warmer air to be displaced gently toward the floor over a larger area. The fan or blower is adapted, by provision of adjustable legs, for use not only as a heat distribution device but also for use as an air circulating means during warm periods. The adjustable legs are designed to be extended for use in supporting the fan or blower in a horizontal position during winter months, and may be retracted to out of the way positions against the fan or blower housing. The fan or blower is also provided with supports whereby it may be disposed vertically for horizontal air movement during warm periods.

A principal object of the invention is to provide methods and apparatus for providing air circulation during both warm and cool periods of the year. Another object of the invention is to provide fan apparatus which may be mounted in two positions for use under different temperature conditions. A further object of the invention is to provide such apparatus which is not unsightly and which is efficient and economical in manufacture and use. Yet another object of the invention is to provide such methods and apparatus whereby unwanted drafts are not created during heating periods.

Other objects and advantages of the invention will appear from the following detailed description of preferred embodiments thereof, reference being made to the accompanying drawings.

BRIEF DESCRIPTIONS OF THE DRAWINGS

FIG. 1 is a side elevation of an apparatus of preferred form according to the invention, and which is useful in practice of the methods of preferred form according to the invention.

FIG. 2 is an elevation taken at line 2—2 of FIG. 1.

FIG. 3 is an enlarged partial elevation showing a portion of the apparatus shown in FIGS. 1 and 2.

FIG. 4 is a further enlarged partial cross section taken at line 4—4 of FIG. 2.

FIG. 5 is a cross section taken at line 5—5 of FIG. 4.

DESCRIPTION OF THE PREFERRED EMBODIMENTS

Figure 6:
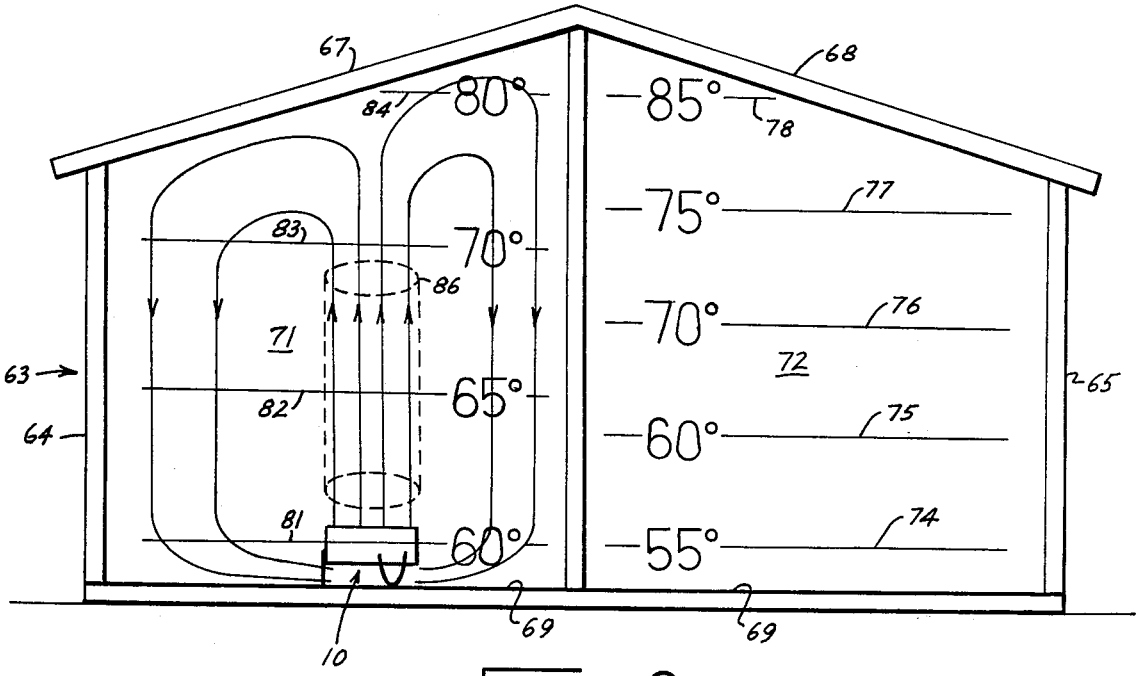
FIG. 6 is a schematic drawing showing the method and apparatus as used during the winter mode of operation.

Referring now to the drawings in detail, and referring first to FIGS. 1–5 of the drawings, a fan or blower device is identified by reference numeral 10. Apparatus 10 includes a cylindrical wall 11 having uniform inturned flanges 12, 13 therearound at its opposite sides. A screen or mesh 15 is disposed against the inner side of each of the flanges 12, 13, affixed in place in any suitable manner, not shown, for example, by tack welding or by nuts or bolts or rivets. A pair of pipes or bars 17, 18, parallel each to the other, are disposed across the cylindrical space within housing 11 as shown in FIG. 1, being affixed to the housing wall at each of their ends by welding. The shafts 17, 18 support an electric drive motor 19 having mounted on its shaft 20 a hub 21 carrying circularly spaced pitched blades 22, four blades being shown. The blades 22 are pitched such that air is propelled in the direction shown by arrows 24 in FIG. 2 when motor 19 is operated. Motor 19 is connected to a suitable source of electrical power by a suitable power cord 19*a*.

A pair of shaped bars 26, 27 are each flattened at each of their ends and affixed to housing 11 by bolts or rivets 29. Each bar 26, 27 is in the form of a shallow squared "U", as best shown in FIG. 1. The bars 26, 27 may also be affixed to the housing at 31 if required for strength and stability of the apparatus.

An axle shaft 33 is disposed through suitable openings through bars 26, 27 and carries wheels 34, 35 at its opposite ends. The apparatus may rest on a surface 38 upon the straight portions 39 of each of the bars 26, 27, the straight portions 39 of the bars being disposed tangentially of housing 11 and spaced parallely apart, as shown. The wheels 34, 35 are somewhat above surface 38 when the apparatus is thus disposed, as is best shown in FIG. 1. A handle 40 is affixed to housing 11 as shown in FIGS. 1–2. By use of the handle 40, the apparatus may be tilted counterclockwise from its position shown in FIG. 1 so that wheels 34, 35 engage surface 38 whereby the apparatus may be rolled therealong to any desired location. The apparatus after being moved may be again disposed upon bar portions 39, or may be supported by three legs 43–45, to be described.

The legs 43–45 are identical, and the detailed description will be confined to leg 43.

Referring now especially to FIGS. 3–5, each leg structure 43–45 includes a shaped band 47 which has a bend at 48 and which has two bends at 49, 50, so that the band is generally V-shaped. At each of its end portions 51, 52, band 47 has a slot 54 longitudinally thereof adapted to receive a bolt or rivet 55 slidably therethrough. Band 47, which serves as the leg, may slide at each slot 54 with respect to each bolt or rivet 55. The bolt or rivet 55 is carried by an angularly outturned portion 57 of a plate 58 which has angular-sided upsets 59, 60, as shown in FIGS. 3 and 4. The band 47 is shown in the extended position in both FIGS. 3 and 4. Bolt or rivet 55 is in the lower end of slot 54 toward the main portion of band 47. Upsets 59, 60 are engaged with side 63 of band end portion 52 at opposite sides of bolt 55, firmly engaged but slidable when forced to do so. By imposition of sufficient force, for example, by hammering on end 67 of band end portion 52, the band may be driven such that slot 54 moves downward (FIG. 4) with regard to bolt or rivet 55 so that the end of band end portion 52 clears upset 59. This results in loosening of the pressure of band end portion 52 against upset 60, as well. With the band end portion moved such that bolt or rivet 55 is disposed in the opposite or upper end of slot 54, the band 47 may be pivoted to the dashed line position 47*a*, and the band may be driven by hammering against bend 48 to drive the slot 54 along bolt or rivet 55 such that the end portion 52 becomes locked against upsets 59, 60 in its dashed line position 52*a*. With the band 47 in position 47*a*, FIG. 3, the band or leg is firmly secured against the side of housing 11 to be out of the way and rattle free.

The unique leg support, capable of providing leg movement to the two positions indicated, not only provides a firm support for the fan or blower device 10 but also provides that the leg is tight and rattle free in either of its positions. The upsets 59, 60 bear against one or the other side of each band end portion 51, 52 such that the band 47 may not be moved without application of substantial force. Therefore, whether the leg is extended or retracted to its position against housing 11, it is firmly supported in a tight and rattle free manner not subject to dislocation accidentally.

The plates 58, 58*a*, as thus indicated in FIG. 3, are identical, one being turned upside down with respect to the other. The two plates 58 for each leg assembly are affixed to housing 11 in any suitable manner, for example, by welding or bolting, as desired.

As shown in FIGS. 2 and 4 of the drawings, the bands 47, forming the retractable leg elements of the legs 43–45 of the apparatus, are outbent slightly at bends 49, 50. This configuration of the legs, disposed slightly angularly outwardly from the housing 11, provides additional stability for the apparatus, and also provides that the bends 48 of the legs will be closely adjacent to or against housing 11 when the legs are in retracted positions. The three legs 43–45 are, therefore, completely out of the way, closely disposed against housing 11 when not in use.

Referring now to FIG. 6 of the drawings, there is indicated a building structure 63 having end walls 64, 65 and dividing wall 66, and having a pitched roof 67, 68 at each side. Within these, and other wall structures completing the building which are not shown in the drawing, there are enclosed the two rooms or spaces 71, 72. Five temperature levels 55° F., 60° F., 70° F., 75° F., and 85° F., are indicated by lines 74–78, respectively, in room 72. These temperature levels indicate an exemplary heat distribution caused by convection within room or space 72 when no forced air circulation is provided therein. The 30° F. temperature differential between the lower and upper parts of the room is not exaggerated, especially in rooms having a relatively high ceiling. An air circulating apparatus 10 is shown disposed in horizontal position supported upon its legs upon floor 69. In space 71, temperature levels 60° F., 65° F., 70° F., and 80° F. are indicated at lines 81–84. respectively. The temperatures in space 71, as compared with the temperatures in space 72, are considerably more uniform from floor to ceiling. The temperature at the upper level in space 71 is 80° f. as compared with temperature of 85° F. at the upper level in space 72. The temperature near the floor in space 71 is 60° F., as compared with a temperature of 55° F. at the lowest level in space 72.

The device 10 causes an upwardly moving column of air 86. The apparatus 10 is a relatively high capacity fan or blower which will deliver a high velocity current of air. Air column 86 should reach substantially to the ceiling of the room or space. It should be noted that the column of air 86 is confined to be entirely or almost entirely above the blower, so that the rapidly moving air is not likely to strike a person in room or space 71. When the column of cool air reaches the ceiling area of space 71, warm air is displaced in a diffused, slow moving downward flow from the ceiling area toward the floor over the remainder of the room area. The warmer air drifts downwardly over substantially all of the room or space area not occupied by the rising air column 86. This downwardly moving air is substantially unnoticeable by persons occupying the room. Therefore, since the rising air column 86 is confined substantially to the space above blower apparatus 10, and the downwardly moving air therearound is moving at a slower rate of speed, drafts are not felt by the room occupants in any noticeable manner, and comfort is achieved. At the same time, the blower device 10 does not include a column or stack structure which is unsightly in the room, and which would interfere with visibility and movement in the room. The warmer air moves downward around the blower apparatus 10 and does not cause unwanted air currents which would disrupt work and cause discomfort in the room.

The air movements caused by blower apparatus 10 causes intermixing of all of the air in the room or space, whereby after a few minutes of operation the air in the room is comfortable at all levels.

During warm and hot periods, when heating is not required, the blower or fan apparatus shown in FIGS. 1 and 2 may be disposed as shown in FIGS. 1 and 2 to rest upon the straight portions 39 of the bars 26, 27, to serve as air circulation means at the lower portions of the room. During the warm months of the year, drafts are not only not objectionable, but are preferred in order that a cooling effect can be felt. The apparatus, therefore, is useful not only during the months of the year when heating is required, but is useful as well during warm and hot periods of the year when cooling is desired. This degree of utility has not been realized before from a single fan or blower apparatus.

The fan or blower 10 may be other than circular in configuration; for example, the fan or blower may be square, with three or four of any other suitable number of the leg assemblies spaced therearound for support of the fan or blower when it is in the horizontal position. If the fan housing is square or rectangular, or of some other shape having at least one flat side, it may rest on the flat side in the vertical position.

While preferred embodiments of the methods and apparatus according to the invention have been described and shown in the drawings, many modifications thereof may be made by persons skilled in the art without departing from the spirit of the invention, and it is intended to protect by Letters Patent all forms of the invention falling within the scope of the following claims.

I claim:

1. Air propelling apparatus, comprising a housing having an air inlet in line with an air outlet, means for supporting an electric motor within said housing with its shaft in line between said inlet and said outlet, blade means carried by said shaft circularly spaced and outwardly disposed therearound, means for connecting said electric motor to an electric power source to enable operation of said electric motor, said housing including at least three leg means spaced about said air inlet for supporting said housing means with said air inlet and said air outlet in line vertically, each said leg means comprising angular bar means pivotally fixed at each of its ends to said housing adjacent the edge of said air inlet and each being movable between a first position against the exterior of said housing and a second position parallel with the wall of said housing and extending therefrom, and detent means for releasably restraining each end of each said bar means in each of said first and second positions.

2. The combination of claim 1, said housing also including support means for supporting said housing means with said air inlet and said outlet in line horizontally, said support means comprising a pair of parallely spaced bar means each fixed at each end to said housing and each having a central portion disposed tangentially of said housing adapted to be disposed against a horizontal surface, and wheel means supported by said bar means out of line with said central portions thereof to be spaced from a said horizontal surface when said central portions are disposed thereagainst and to be rollably engaged against a said horizontal surface when said housing is rotated about its axis past a point where corresponding ends of said central bar portions of said bar means engage at said horizontal surface.

3. The combination of claim 1 or 2, said housing being in the form of an open ended hollow cylinder one end of which comprises said air inlet and the other end of which comprises said air outlet.

4. The combination of claim 1 or 2, said means for supporting an electric motor within said housing comprising bar means fixed between opposite sides of said housing.

5. Air propelling apparatus, comprising an open ended hollow cylindrical housing having an air inlet formed by one of its ends in line with an air outlet formed by the other of its ends, bar means fixed between opposite sides of said housing for supporting an electric motor within said housing with its shaft in line with said inlet and said outlet, blade means carried by said shaft circularly spaced and outwardly disposed therearound, means for connecting said electric motor to an electric power source to enable operation of said electric motor, said housing including leg means for supporting said housing means with said air outlet disposed vertically in line above said air inlet, said housing also including support means for supporting said housing means with said air inlet and said air outlet in line horizontally, said leg means being retractable by pivotal movements thereof from extended positions around said air inlet to retracted positions against said housing; each said leg means comprising an elongate element having a central bowed portion and having its opposite end portions parallely laterally spacedly disposed, each said end portion having a longitudinal slot therethrough and said slots being disposed to face one another, plate means fixed to extend from said housing adjacent each of said slots and each of said end portion being pivotally affixed to one of said plate means by cross pin means supported by the plate means and disposed through said slot to be slidable along the length of the slot, a pair of means supported by said housing adjacent each of said end portions and each of said pair of means being disposed one at each side of the pin means and positioned to be frictionally engaged with the end portion at opposite sides of the pin means with the end portion disposed in each of opposite directions with respect thereto when the pin means is disposed in one end of the slot, each said end portion being released from said frictional engagement with the pair of means when said elongate element is moved to a position wherein said pin means are in the other ends of said slots whereby said elongate element may be pivotally moved to move said end portions between positions in said opposite directions, said elongate element being extended from said housing when said end portions are in position in one of said opposite directions and being retracted against said housing when said end portions are in position in the other of said opposite directions.

6. The combination of claim 5, said end portions being in a plane angular to the plane of said bowed portion whereby said leg means are angularly divergent from said housing when extended.

* * * * *